US007537147B2

(12) United States Patent
Ebbesson et al.

(10) Patent No.: US 7,537,147 B2
(45) Date of Patent: May 26, 2009

(54) HAMMER TACKER

(75) Inventors: Jan Ebbesson, Åsenhöga (SE); Bjorn Soderholm, Mullsjö (SE)

(73) Assignee: Isaberg Rapid AB, Hestra (SE)

( * ) Notice: Subject to any disclaimer, the term of this patent is extended or adjusted under 35 U.S.C. 154(b) by 19 days.

(21) Appl. No.: 11/911,531

(22) PCT Filed: Mar. 9, 2006

(86) PCT No.: PCT/SE2006/000300

§ 371 (c)(1),
(2), (4) Date: Oct. 13, 2007

(87) PCT Pub. No.: WO2006/110074

PCT Pub. Date: Oct. 19, 2006

(65) Prior Publication Data

US 2008/0190983 A1 Aug. 14, 2008

(30) Foreign Application Priority Data

Apr. 15, 2005 (SE) ..... 0500841

(51) Int. Cl.
*B25C 5/11* (2006.01)

(52) U.S. Cl. ..... 227/133; 227/120; 227/127; 227/134

(58) Field of Classification Search ..... 227/120, 227/136, 133, 134, 123, 126, 127, 131, 147
See application file for complete search history.

(56) References Cited

U.S. PATENT DOCUMENTS 2,311,412 A * 2/1943 Pankonin ..... 227/126
2,375,419 A 5/1945 Krantz
2,519,617 A * 8/1950 Wember ..... 227/133
2,524,061 A * 10/1950 Lindstrom ..... 227/127
2,769,173 A * 11/1956 Lindstrom ..... 227/127
2,801,414 A * 8/1957 Mueller ..... 227/127
3,945,550 A * 3/1976 Monacelli ..... 227/126
4,113,164 A * 9/1978 Muthenthaller ..... 227/124
5,009,356 A * 4/1991 Chang ..... 227/120
5,335,839 A * 8/1994 Fealey ..... 227/132
5,639,007 A * 6/1997 Nakamura ..... 227/109

(Continued)

FOREIGN PATENT DOCUMENTS

GB 2383287 A 6/2003

(Continued)

*Primary Examiner*—Scott A. Smith
(74) *Attorney, Agent, or Firm*—Miles & Stockbridge P.C.

(57) ABSTRACT

Hammer tacker (1) for driving staples (7) into a workpiece, which tacker comprises a body (2) and a magazine (5) which is pivotably connected by connecting element (6) to the body in such a way that at the front edge of the tacker the magazine can move into and out of the body, and which magazine is provided with an endpiece (9) containing an elongate staple rail (10) which in the longitudinal direction of the magazine is slidably fitted to the magazine and is secured to the magazine by securing elements (13,14) and which, when fitted, leaves a gap (23) between its front edge (16) and the tacker's front edge (22), whereby the securing elements (13,14) take the form of a hook (13) integral with the staple rail/magazine (10, 5) and an aperture (14) on the magazine/staple rail (5, 10) and lockingly engage with one another when the staple strip is fitted to the magazine.

8 Claims, 9 Drawing Sheets

U.S. PATENT DOCUMENTS 5,816,470 A * 10/1998 Plato et al. ..... 227/132
5,988,478 A 11/1999 Marks
6,012,623 A * 1/2000 Fealey ..... 227/134
6,367,676 B1 4/2002 Opland et al.
6,550,660 B1 * 4/2003 Chlebowski et al. ..... 227/133
7,014,090 B1 * 3/2006 Chang ..... 227/132
7,240,819 B2 * 7/2007 Chang ..... 227/132
7,395,955 B2 * 7/2008 Zins et al. ..... 227/132

FOREIGN PATENT DOCUMENTS

SE 441657 B 10/1985

* cited by examiner

HAMMER TACKER

TECHNICAL FIELD

The present invention relates to a hammer tacker for driving staples into a workpiece, which tacker comprises a body and a magazine which is pivotably connected by connecting means to the body in such a way that at the front edge of the tacker said magazine can move into and out of the body, which magazine comprises an endpiece containing an elongate staple rail which in the longitudinal direction of the magazine is slidably fitted to the magazine and is secured to the magazine by securing means and which, when fitted, leaves a gap between its front edge and the front edge of the tacker.

STATE OF THE ART

A hammer tacker of the kind indicated in the introduction is previously known. However, that known tacker has a number of disadvantages. One such disadvantage is that the securing means takes the form of a snap fitting which is actuatingly applied to the staple rail by an elastic means and which snaps in, to cooperate with an element disposed in the magazine, when the staple rail is in a fitted position. This design means that the securing means, which comprises a relatively large number of parts, is readily worn by the forces which occur in the tacker during use and thereby loses its function. A further disadvantage of the known tacker is that it lacks a locking function to reliably prevent the securing means from losing its securing function when the magazine in the course of a working stroke moves into the body. Moreover, the previous tacker has the disadvantage of lacking means of pushing the staple rail forwards in order to ensure that the size of the gap at the front edge of the tacker does not change.

PROBLEM

There is thus a need to provide a tacker of the kind indicated in the introduction which is of a design such that it is not readily worn by the forces which occur during use, that it has a locking function to prevent the securing means from losing its securing function when the staple magazine moves into the body and that it has means for ensuring that the gap between the staple rail and the front edge of the stapler does not increase.

PROPOSED SOLUTION

The present invention overcomes the disadvantages indicated above of a tacker of the kind indicated in the introduction which is characterised in that the securing means take the form of a hook means firmly attached to the staple rail/magazine and an aperture provided in the magazine/staple rail and lockingly engage with one another when the staple rail is fitted to the magazine.

The present invention is further characterised in that an elastic means presses the hook means and the aperture together to engage with one another.

The present invention is still further characterised in that the staple rail comprises a spacing element which, when the magazine is pressed into the body, cooperates with the body and prevents the hook means from moving out of engagement with the aperture.

The present invention is also characterised in that the elastic means also causes the staple rail to move forwards.

Finally, the present invention is characterised in that the elastic means takes the form of a leaf spring.

BRIEF DESCRIPTION OF THE DRAWINGS

The invention is described below with reference to the attached drawings, in which.

PREFERRED EMBODIMENT EXAMPLE

Figure 1:
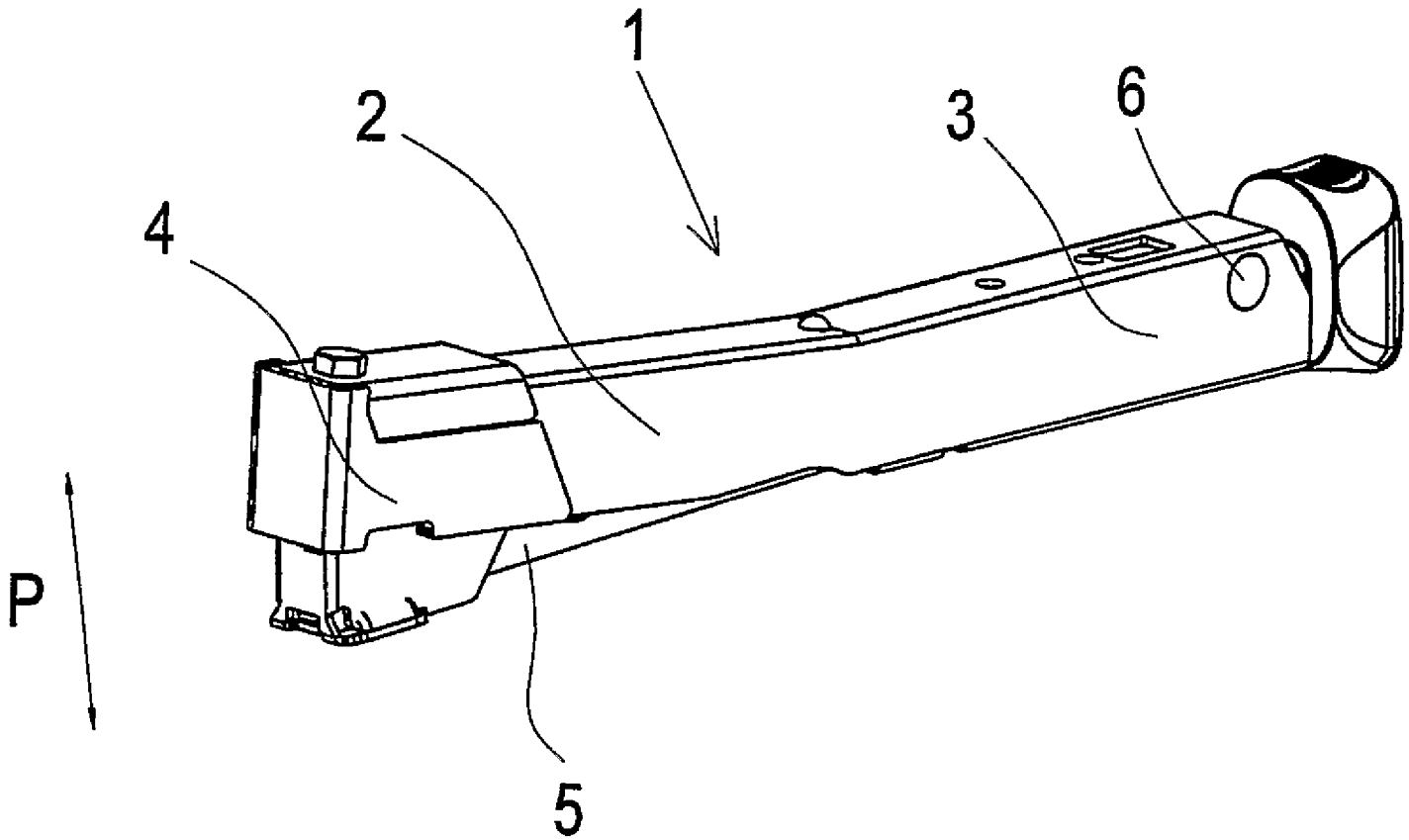
FIG. 1 is a general view of a hammer tacker according to the present invention.
Figure 2:
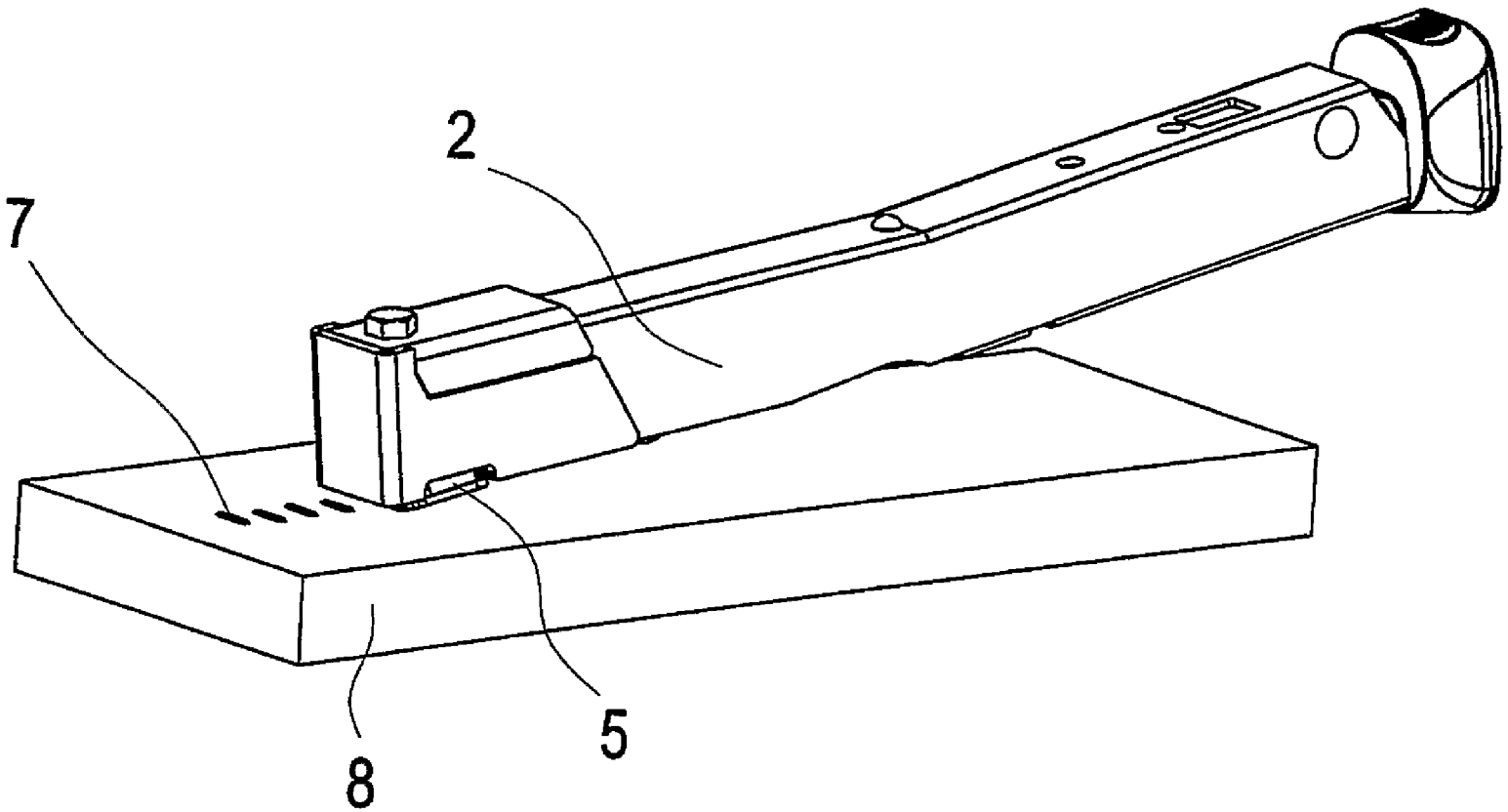
FIG. 2 is a view corresponding to FIG. 1, showing a staple being driven into a workpiece.
Figure 3:
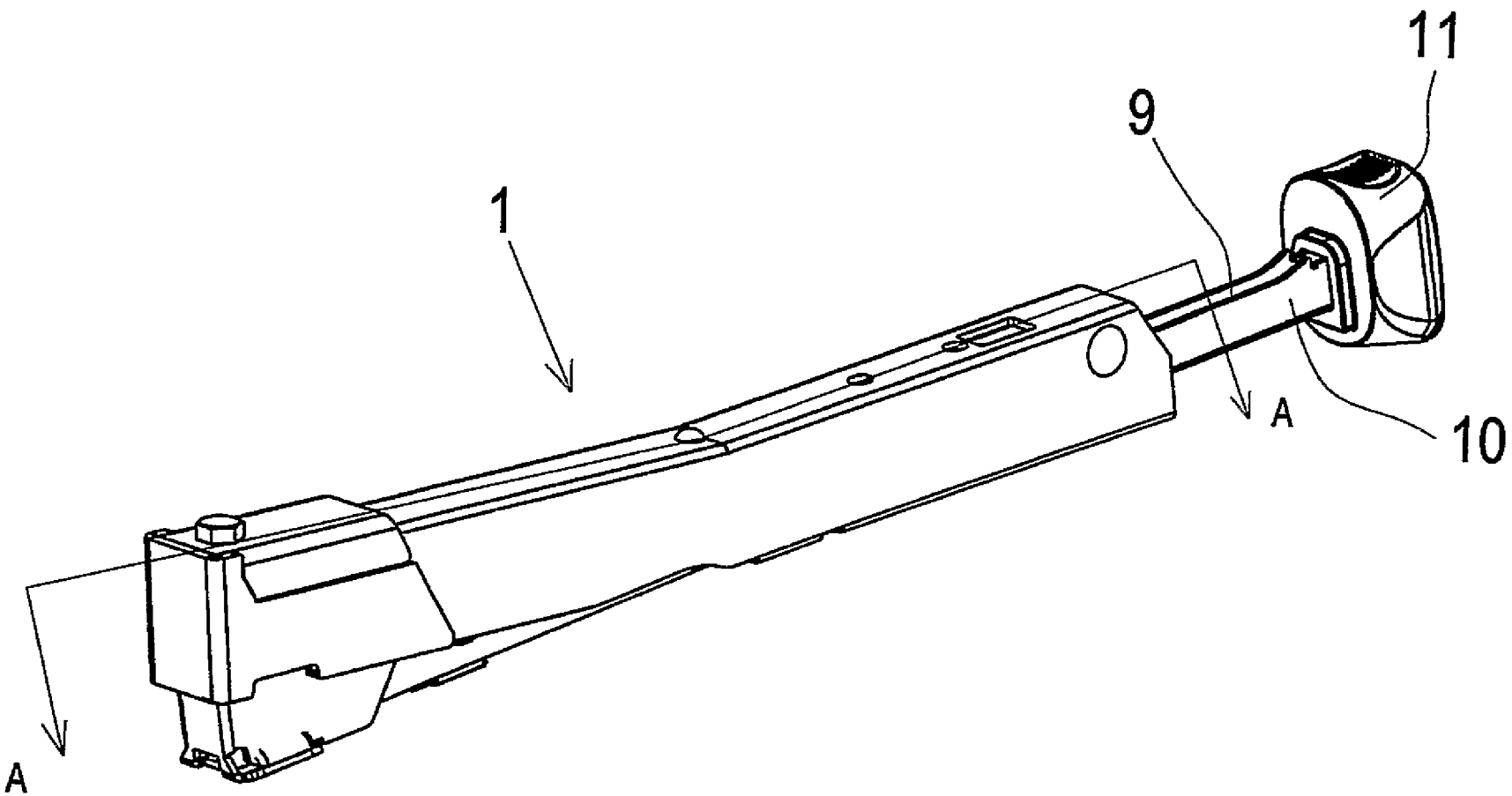
FIG. 3 is a view corresponding to FIG. 1 in which the endpiece of the tacker has been pulled out.
Figure 4:
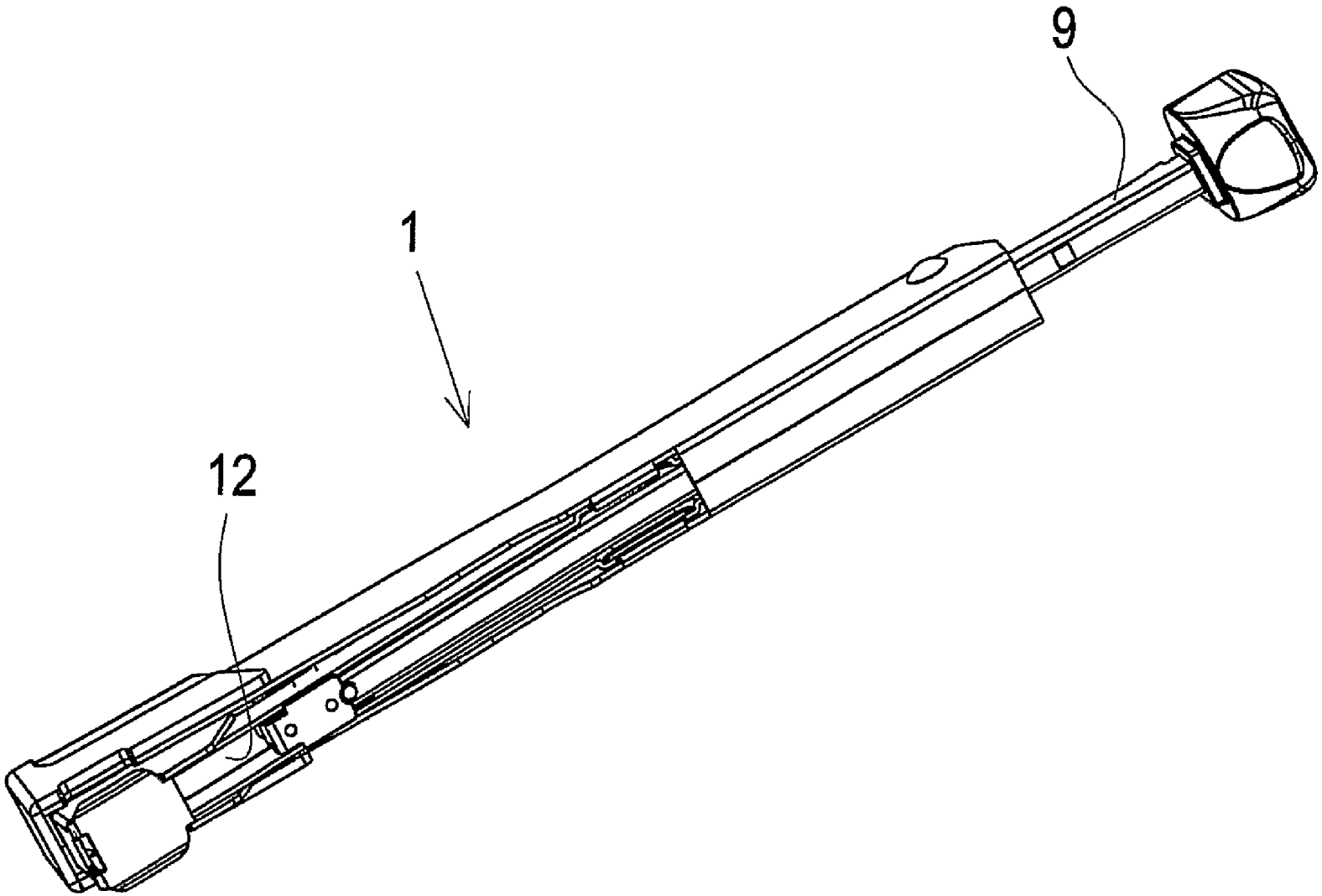
FIG. 4 is a view corresponding to FIG. 3 as viewed from below.
Figure 5:
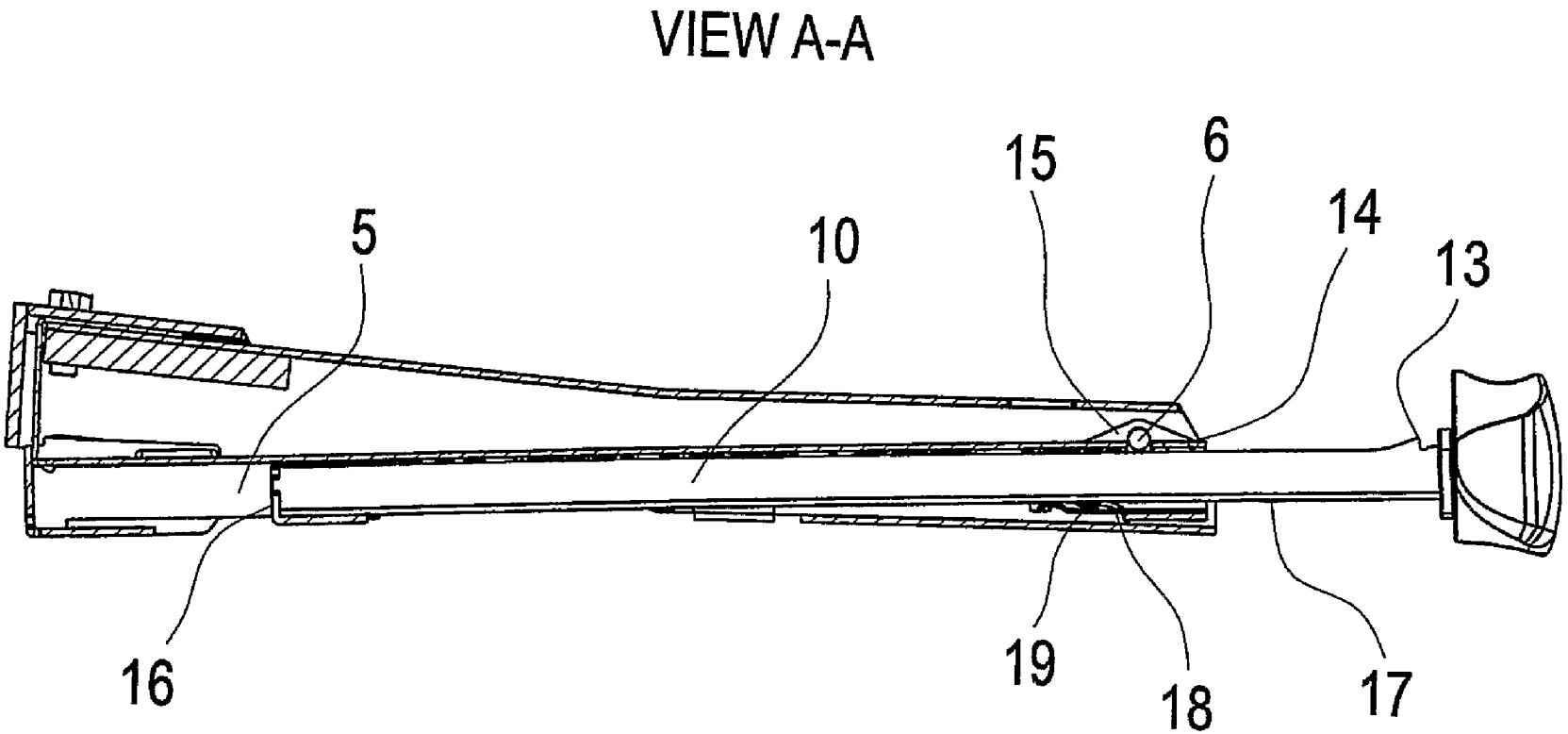
FIG. 5 is a sectional view along the line A-A in FIG. 3.
Figure 6:
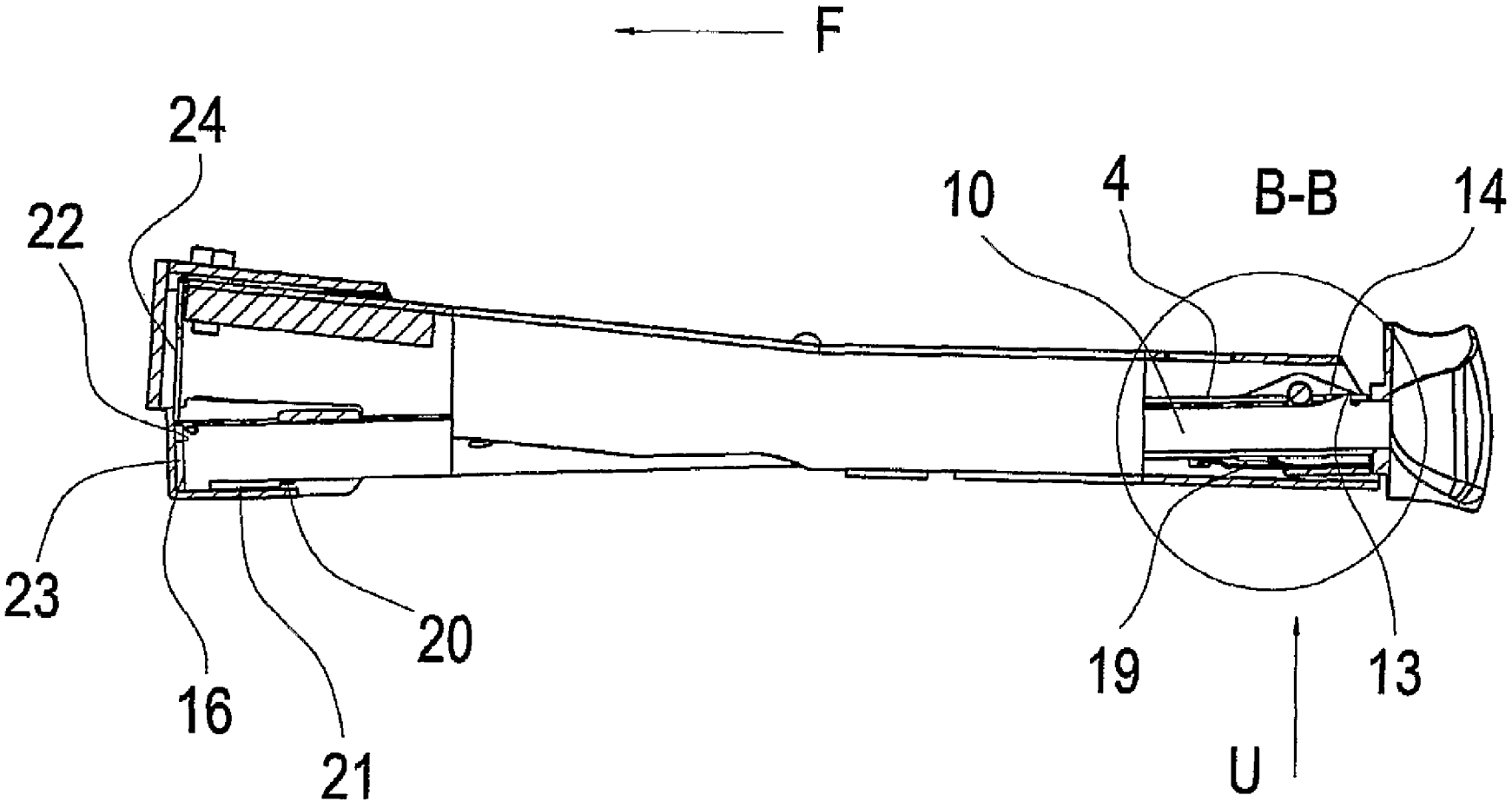
FIG. 6 is a side view of a tacker in which the magazine is outside the body and in which forward and rear portions are depicted in section.
Figure 7:
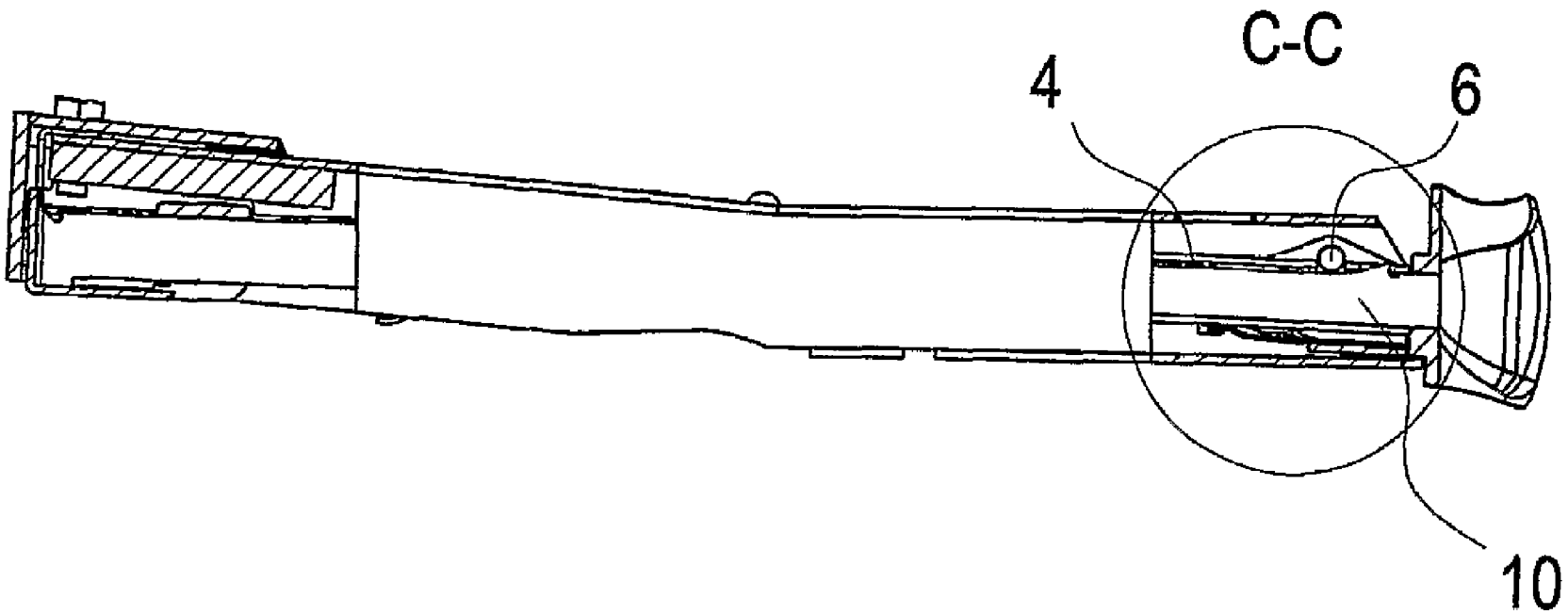
FIG. 7 is a view corresponding to FIG. 6 in which the magazine has moved into the body.

FIG. 1 depicts a hammer tacker 1 which comprises a body 2 which has at its rear portion a handgrip 3 and at its front portion a stapling head 4. The drawing also shows a magazine 5 which in a known manner is connected pivotably by a pin 6 to the body so that the magazine can move into and out of the body 2 in the direction indicated by the double arrow P. FIG. 2 depicts the tacker in a position in which in a known manner it drives a staple 7 into a workpiece 8. The drawing shows the tacker in the position in which a staple has been driven into the workpiece and, as may be seen, in this position the magazine 5 has moved into the body 2. FIG. 3 shows an endpiece 9 which in a known manner is fitted to the magazine 5. The endpiece is slidably fitted to the magazine and is fitted to the magazine by being introduced into the magazine from the rear edge, and since this fitting is known and obvious to one skilled in the art no further description of it will be given here. The endpiece contains a staple rail 10, an end plug 11 and a feed device which is not depicted in the drawing but is generally known to one skilled in the art. FIG. 4 depicts the tacker in the position shown in FIG. 3 as viewed from below and shows that in this position the magazine is open, making it possible to load staples to the inside 12 of the magazine in a manner known to one skilled in the art. FIG. 5 shows the staple rail 10 accommodated in the magazine 5. It also shows that the staple rail is provided with an integral hook means 13 and that the magazine has an aperture 14. It also shows that the magazine has a coupling lug 15 through which the pin 6 extends, thereby connecting the magazine pivotably to the body. The staple rail has at the front edge a surface 16 whose function will be explained below, and at the rear edge the rail is provided with a protrusion 17. The magazine is provided at its rear edge with an elastic means 18 in the form of a leaf spring 19 whose function will likewise be explained below. FIGS. 6 and 7 show that when the staple rail is fitted to the magazine, the hook means 13 is inserted in the aperture 14. In this position the hook means is held in the aperture by the leaf spring 19 urging the staple rail in the direction indicated by the arrow U. The staple rail has at the front edge a boss 20 which comes to abutment against a stop 21 attached to the body, which stop prevents the possibility of the staple rail moving further forwards in the direction F, thus leaving a gap 23 between the surface 16 and an opposite surface 22 provided at the front edge of the stapling head, through which gap a staple fed forwards (not depicted in the drawings) can be driven by a driver 24 for insertion in a workpiece. In FIG. 6, the magazine has its front edge outside the body and in FIG. 7 the magazine has moved into the body, a movement effected by the magazine pivoting about the pin 6.

Figure 8:
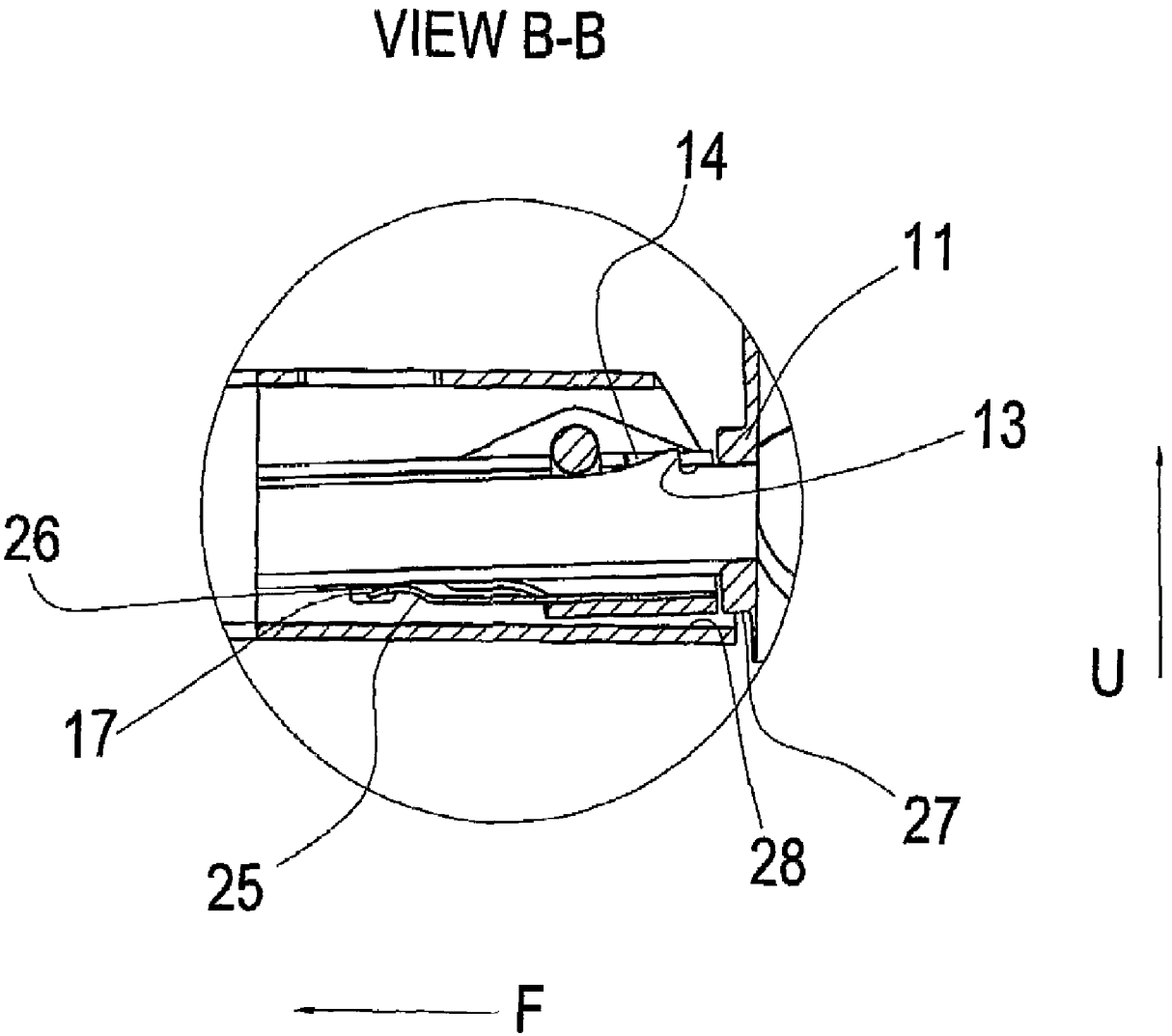
FIG. 8 is an enlarged view of the region B-B in FIG. 6.
Figure 9:
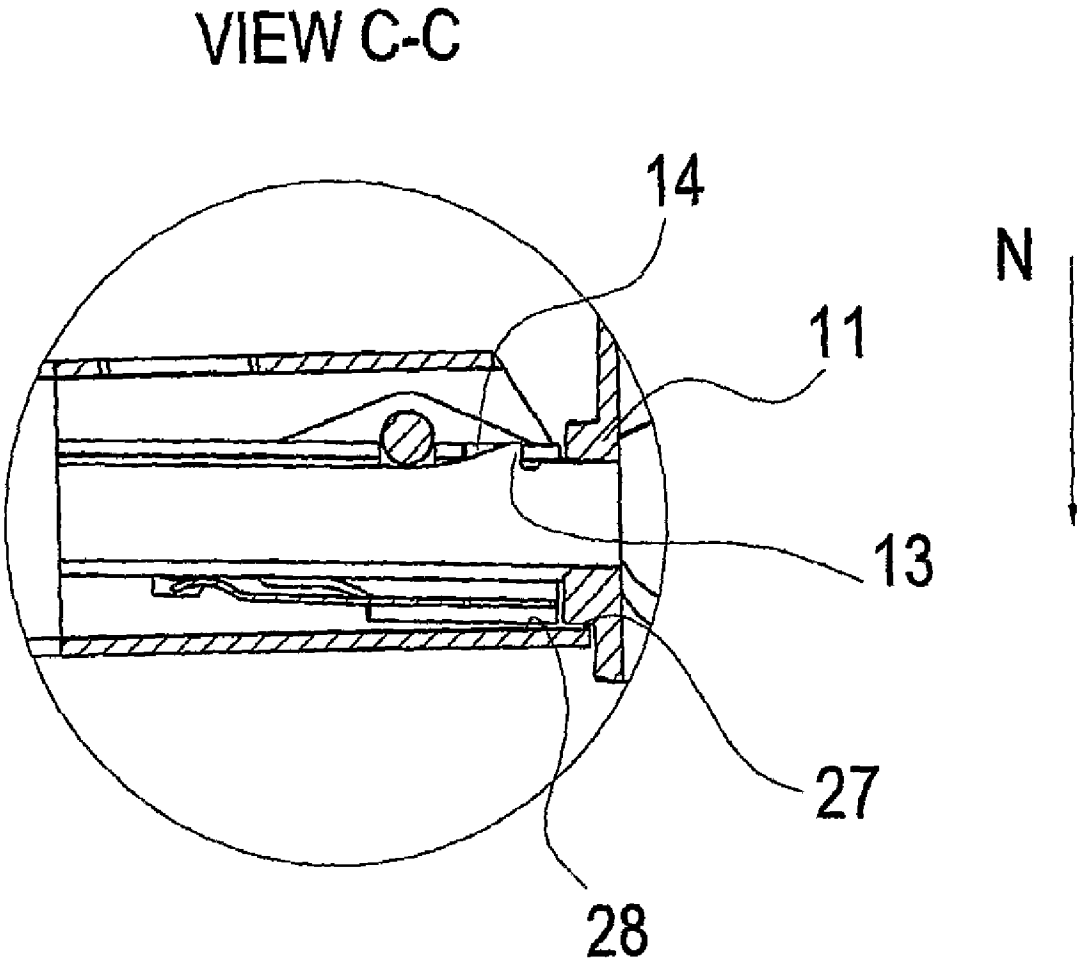
FIG. 9 is an enlarged view of the region C-C in FIG. 7.

FIGS. 8 and 9 show that the portion of the leaf spring which abuts against the staple rail has an arcuate shape 25 and that the protrusion 17 likewise has an arcuate shape 26, with the result that when the leaf spring presses the staple rail in the direction U the cooperation between the two arcuate shapes will also push the staple rail forwards in the direction indicated by the arrow F, thereby ensuring that the gap 23 remains the same size as that determined by the cooperation between the boss 20 and the stop 21. The drawings also show that the end plug 11 is provided with a spacing element 27 and the body with a stop surface 28. In FIG. 9 the front edge of the magazine has moved into the body and the fact that the magazine pivots about the pin 6 results in the spacing element coming close up against the stop surface 28, thereby preventing the staple rail from moving downwards in the direction indicated by the arrow N and hence ensuring that the hook means 13 cannot move out of engagement with the aperture 14. When the front edge of the magazine is outside the body, the spacing element 27 will be in a position such as that depicted in FIG. 8 and the hook means 13 will then be able to move down and out of the aperture 14.

Since the hook means forms an integral part of the staple rail, said means will not be subject to wear such as otherwise occurs in cases where it takes the form of a freestanding part connected to the staple rail, and the fact that the spacing element 27 and the stop surface 28 cooperate and prevent the hook means 13 from losing its engagement with the aperture 14 when the staple magazine 5 moves into the body ensures that the staple rail remains in the magazine when the tacker is used.

In the embodiment depicted, the hook means is shown integral with the staple rail and the aperture accommodated in the magazine. However, as will readily be appreciated by one skilled in the art, it is possible, without departing from the invention, for the reverse to be the case, whereby the hook means is situated in the magazine and the aperture in the rail.

The invention claimed is:

1. A hammer tacker for driving staples into a workpiece, which tacker comprises a body and a magazine which is pivotably connected by connecting means to the body in such a way that at a front edge of the tacker said magazine can move into and out of the body, which magazine comprises an endpiece containing an elongate staple rail which in a longitudinal direction of the magazine is slidably fitted to the magazine and is secured to the magazine by securing means and which, when fitted, leaves a gap between a front edge of the staple rail and the tacker's front edge, CHARACTERISED in that the securing means takes the form of a hook means integral with one of the staple rail and the magazine and an aperture on the other of the staple rail and the magazine to lockingly engage with one another when a staple strip is fitted to the magazine.

2. A hammer tacker according to claim 1, CHARACTERISED in that an elastic means presses the hook means and the aperture together to engage with one another.

3. A hammer tacker according to claim 2, CHARACTERISED in that the elastic means also causes the staple strip to move forward.

4. A hammer tacker according to claim 2, CHARACTERISED in that the elastic means takes the form of a leaf spring.

5. A hammer tacker according to claim 2, CHARACTERISED in that the staple rail comprises a spacing element which, when the magazine is pushed into the body, cooperates with the body and prevents the possibility of the hook means moving out of engagement with the aperture.

6. A hammer tacker according to claim 5, CHARACTERISED in that the elastic means also causes the staple strip to move forward.

7. A hammer tacker according to claim 5, CHARACTERISED in that the elastic means takes the form of a leaf spring.

8. A hammer tacker according to claim 1, CHARACTERISED in that the staple rail comprises a spacing element which, when the magazine is pushed into the body, cooperates with the body and prevents the possibility of the hook means moving out of engagement with the aperture.

* * * * *